United States Patent [19]

Castaneda et al.

[11] 4,062,709

[45] Dec. 13, 1977

[54] INHIBITED FLUOROCARBON ROCKET PROPELLANT

[76] Inventors: Victor F. Castaneda, 218 Iowa St.; Homer L. Davis, P.O. Box 503, both of Ridgecrest, Calif. 93555

[21] Appl. No.: 762,662

[22] Filed: Sept. 25, 1968

[51] Int. Cl.[2] ..... C06B 45/10

[52] U.S. Cl. ..... 149/19.3; 149/42; 149/44; 149/76; 102/103

[58] Field of Search ..... 102/103; 149/2, 19.3, 149/20, 42, 7, 76, 44

[56] References Cited

U.S. PATENT DOCUMENTS

| | | | |
|---|---|---|---|
| 2,917,424 | 12/1959 | Hirsch et al. | 149/7 X |
| 2,976,678 | 3/1961 | Kennedy | 149/7 X |
| 2,977,884 | 4/1961 | Mahon et al. | 149/7 X |
| 2,987,388 | 6/1961 | Stanley | 149/7 X |
| 2,999,462 | 9/1961 | Mosher et al. | 149/7 X |
| 3,012,506 | 12/1961 | Mosher et al. | 149/7 X |
| 3,012,507 | 12/1961 | Mosher et al. | 149/7 X |
| 3,012,508 | 12/1961 | Stanley | 149/7 X |

*Primary Examiner*—Stephen J. Lechert, Jr.
*Attorney, Agent, or Firm*—R. S. Sciascia; Roy Miller

[57] ABSTRACT

A fluorocarbon bound rocket propellant grain provided with a compatible burn inhibitor on selected areas, particularly the outer surface, which is inexpensive and simple to apply.

3 Claims, 2 Drawing Figures

INVENTORS.
VICTOR E. CASTANEDA
HOMER L. DAVIS
BY
ROY MILLER
ATTORNEY.

INHIBITED FLUOROCARBON ROCKET PROPELLANT

The invention described herein may be manufactured and used by or for the Government of the United States of America for governmental purposes without the payment of any royalties thereon or therefor.

BACKGROUND OF THE INVENTION

The present invention relates to a burn inhibitor propellant grains having a fluorocarbon binder as one of its constituents.

To prevent burning on certain areas on the surface of a propellant grain, these surfaces are coated with a material which does not readily burn. Inhibitors in the early rocket propellants consisted of strips of plastic cemented to the grain according to a prescribed pattern. Many of the recent rockets use the internal tubular charge in which burning is initiated at the inner surface, progressing outward. These grains must be so inhibited or restricted that no burning on the outer surface, and the ends may also be inhibited. The development of satisfactory inhibiting materials and techniques is considered by many to be one of the greatest problems to overcome in the advancement of rocket technology. In case-bonded propellants, that is, those propellants whose outer surface is bonded directly to the rocket motor casing, only the ends need the inhibiting material. The greatest use of inhibitors is for the cartridge loaded propellants or flares wherein the propellant grain is fully cured and then slipped into the motor casing. The problem of finding materials suitable for inhibiting the extruded and cast fluorocarbon bound propellants is difficult to solve because of plasticizer migration into the grain, incompatibility of the inhibitor and fluorocarbon propellant composition and cracking of the material after curing. The present invention overcomes the above mentioned difficulties.

SUMMARY OF THE INVENTION

The invention relates to a method of inhibiting a fluorocarbon bound propellant grain and to the inhibited grain.

It is the general purpose of this invention to provide a means for restricting the burning of any selected surface of fluorocarbonn bound propellant grains which is better than any means known at the present time, and has the economic advantage of being simple and inexpensive.

BRIEF DESCRIPTION OF THE DRAWINGS

A physical embodiment of the invention is shown in the attached drawing wherein.

DESCRIPTION OF THE INVENTION

Figure 1:
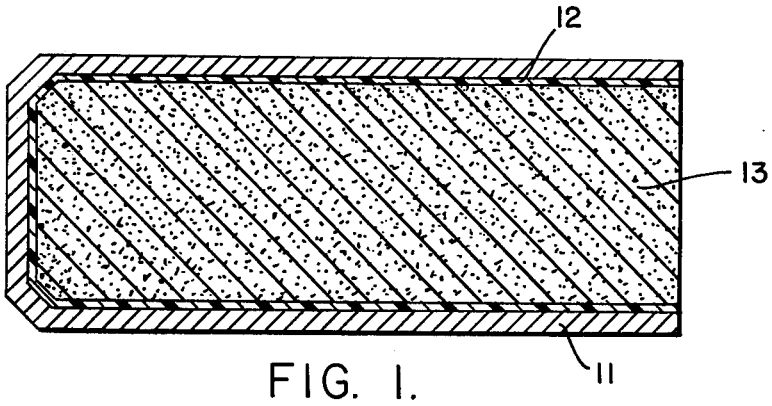
FIG. 1 shows in longitudinal cross-section a propellant charge restricted with a layer of inhibitor according to this invention.

The grain shown in FIG. 1 comprises a fluorocarbon propellant grain 13, of a conventional cylindrical form positioned inside a metal motor casing 11. Grain 13 is provided with a burn inhibitor layer 12 which is intimately bonded to the surface of said grain 13.

In accordance with the present invention applicants discovered that a material eminently suitable for a burn inhibitor for any selected area of a fluorocarbon bound propellant grain is one compounded from a modified diglycidyl ether of bisphenol A type epoxy resin in major proportion and a polymeric amido-amine hardner in minor proportion. The ingredients are available commercially in two parts and sold as "Neoprene Cable Jacket Primer (TC-2080)," by EPD Industries. The materials should be mixed only in amounts to be used within a period of 1 hour as that is the pot life of the mixture. This product is normally used to prepare neoprene cable jackets for molding of connector back shells and cable junctions. It is a liquid and can be applied to the cured grain by dipping the grain into the liquid, brushing, spraying, painting, or other suitable means. Easier application results if the grain is heated to about 150° F. If the grain is large, the liquid may be warmed to about 150° F. and sprayed or brushed onto the surface of the fluorocarbon bound grain. When the inhibitor material adhering to the surface has cooled, it solidifies and forms a basic layer intimately bonded to the selected grain surface. If desired a second or third dipping or spraying may be provided to obtain a thicker layer.

The preferred propellant composition which was coated with the restricting material consists essentially of 15% by weight polytetrafluoreothylene (Teflon), 15% by weight of the copolymer of vinylidene fluoride and perfluoropropylene (Viton), 49.5% by weight of ammonium perchlorate, 19.5% by weight aluminum and 1% by weight sodium fluoride. The composition which was discovered by applicants to be so eminently satisfactory on the surface of this grain as a burn inhibitor comprises a mixture of 80 parts by weight modified diglycidyl ether of bisphenol A type epoxy resin and 20 parts by weight amido-amine hardner. Diglycidyl ether of bisphenol A (para, para-isopropylidenediphenol) is obtained by reacting epichlorohydrin with bisphenol A in the presence of a caustic such as sodium hydroxide. The cured fluorocarbon propellant grain was supported on a platform and the mixture which was warmed to about 150° F. was sprayed onto the surface of the grain until a layer of the desired thickness was obtained. The layer was then permitted to cool to room temperature for about an hour. Several grains were coated and stored at room temperature for 5 weeks before testing was started.

Figure 2:
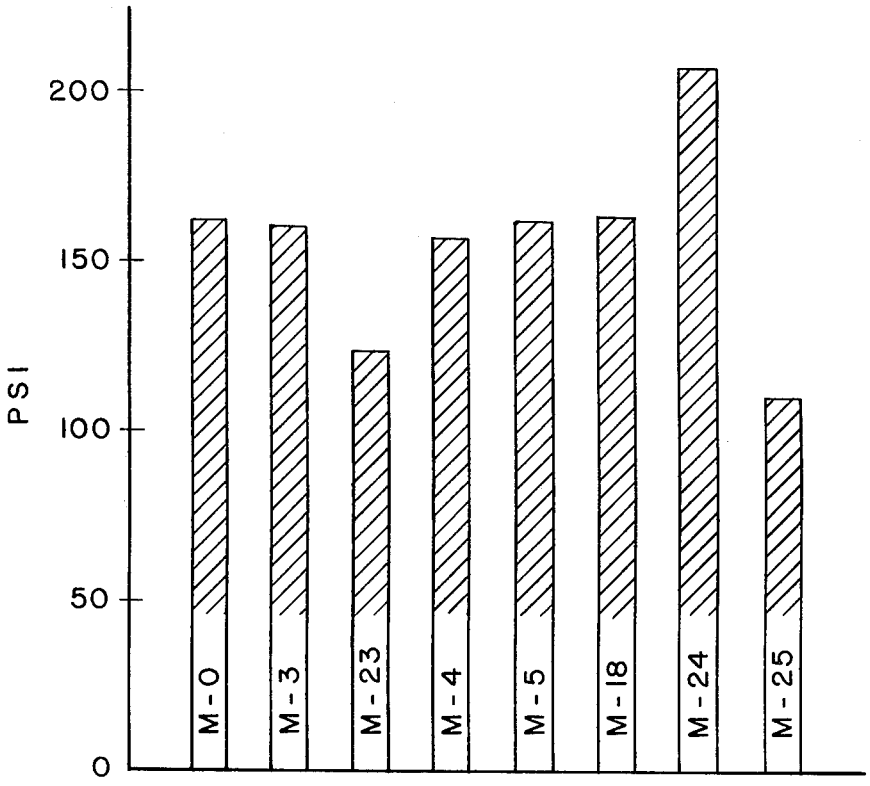
FIG. 2 is a graph comparing the tensile bond strength of the inhibitor used in this invention with others used heretofore.

The inhibitor layer so formed possesses unexpectedly excellent tensile strength and far surpasses other burn inhibiting materials used heretofore on fluorocarbon bound propellant or flare grains and/or charges. In FIG. 2 there is shown a comparison of the burn inhibitor used by applicants designated M-24 with others identified below used on fluorocarbon-bound solid propellant surfaces:

- M-0 A polyurethane inhibitor comprising a mixture of polypropylene glycol, 2,4-tolylene diisocyanate, N-mono(hydroxethyl)-N,N',N'-tris(2 hydroxypropyl) ethylene-diamine, ferric acetylacetonate, and phenyl-$\beta$-naphthyl amine.
- M-3 Same inhibitor as M-0 above with carbon black added.
- M-23 Propellant grain was washed with soap and water prior to applying same inhibitor as defined in M-0 above.
- M-4 A fluorocarbon bound propellant was coated with the inhibiting material defined as M-0 above.
- M-5 An RTV Silicone inhibitor defined as divinyl tetramethyl disiloxane.

M-25 Inhibitor comprising a first layer of Eastman 910 (methyl-2-cyanoacrylate) and a second layer of polyurethane defined in M-0 above.

Owing to the close adherence and tenacity of this inhibiting layer shown as M-24 on FIG. 2 under extreme heat, undesired burning irregularities is minimized or substantially prevented along the surfaces of the fluorocarbon bound propellant grains; and burning is restricted to the desired burning surface which is left uncoated.

What is claimed is:

1. The method of restricting the burning of fluorocarbon bound propellant grains which comprises spraying the grain with a mixture consisting of 80 parts by weight modified diglycidyl ether of para, para'-isopropylidenediphenol, and 20 parts by weight polymeric amido-amine hardner at a temperature ranging from 100° F. to 150° F., permitting a layer of said mixture to deposit on said grain, and cooling for about one hour at room temperature until said layer is cured.

2. The method of claim 1 wherein said propellant consists essentially of about 15% by weight polytetrafluoroethylene, about 15% by weight of the copolymer of vinylidene fluoride and perfluoropropylene, about 49.5% by weight ammonium perchlorate, about 19.5% by weight aluminum and about 1% by weight sodium fluoride.

3. The fluorocarbon bound propellant grain having its outer surface covered with a layer of restrictive burning material consisting essentially of a mixture of about 80 parts by weight modified diglycidyl ether of para, para'-isopropylidenediphenol type liquid epoxy resin and about 20 parts by weight of a polymeric amido-amine hardner; said grain comprising about 15% by weight polytetrafluoroethylene, about 15% by weight of the copolymer of vinylidene fluoride and perfluoropropylene, about 49.5% by weight ammonium perchlorate, about 19.5% by weight aluminum and about 1% by weight sodium fluoride.

* * * * *